US005723246A

United States Patent [19]

Aoki et al.

[11] Patent Number: 5,723,246

[45] Date of Patent: Mar. 3, 1998

[54] BINDER RESIN AND TONER FOR ELECTROSTATIC DEVELOPMENT CONTAINING THE SAME

[75] Inventors: Katsutoshi Aoki; Yoshihiro Ueno; Tetsuhiro Semura; Shinji Moriyama; Kuniyasu Kawabe, all of Wakayama, Japan

[73] Assignee: Kao Corporation, Tokyo, Japan

[21] Appl. No.: 652,308

[22] Filed: May 23, 1996

[30] Foreign Application Priority Data

May 23, 1995 [JP] Japan ..... 7-149509

[51] Int. Cl.[6] ..... G03G 9/087

[52] U.S. Cl. ..... 430/109; 430/114

[58] Field of Search ..... 430/109, 110, 430/114

[56] References Cited

U.S. PATENT DOCUMENTS

| | | | |
|---|---|---|---|
| 3,909,258 | 9/1975 | Kotz | 96/1 R |
| 4,121,931 | 10/1978 | Nelson | 96/15 D |
| 4,804,622 | 2/1989 | Tanaka et al. . | |
| 4,933,252 | 6/1990 | Nishikawa et al. . | |
| 4,939,059 | 7/1990 | Kawabe et al. . | |
| 5,215,849 | 6/1993 | Makuta et al. . | |
| 5,476,742 | 12/1995 | Tavernier et al. | 430/109 |
| 5,483,016 | 1/1996 | Aoki et al. | 430/109 |
| 5,541,030 | 7/1996 | Sano et al. | 430/109 |

FOREIGN PATENT DOCUMENTS

| | | |
|---|---|---|
| 59-231549 | 12/1984 | Japan . |
| 61-101558 | 5/1986 | Japan . |
| 61-155463 | 7/1986 | Japan . |
| 61-155464 | 7/1986 | Japan . |
| 62-195678 | 8/1987 | Japan . |
| 63-068850 | 8/1988 | Japan . |
| 63-279261 | 11/1988 | Japan . |
| 1077075 | 3/1989 | Japan . |
| 1155362 | 6/1989 | Japan . |

*Primary Examiner*—John Goodrow

*Attorney, Agent, or Firm*—Birch, Stewart, Kolasch & Birch, LLP

[57] ABSTRACT

The binder resin for producing a toner includes the following three resins (A) to (C): resin (A) having a softening point of 120° C. or more and 170° C. or less, a glass transition temperature of 58° C. or more and less than 75° C., and a weight percentage of components insoluble to chloroform at 25° C. of 5% by weight or more and 50% by weight or less; resin (B) having a softening point of 90° C. or more and 120° C. or less, a glass transition temperature of 58° C. or more and less than 75° C., and a weight percentage of components insoluble to chloroform at 25° C. of less than 5% by weight; and resin (C) having a softening point of 80° C. or more and less than 110° C., a glass transition temperature of 45° C. or more and less than 58° C., and a weight percentage of components insoluble to chloroform at 25° C. of less than 5% by weight.

7 Claims, No Drawings

BINDER RESIN AND TONER FOR ELECTROSTATIC DEVELOPMENT CONTAINING THE SAME

BACKGROUND OF THE INVENTION

1. Field of the Invention

The present invention relates to a binder resin for producing a toner for electrostatic development having excellent low-temperature fixing ability, offset resistance, and blocking resistance, and a toner for electrostatic development containing the above binder resin.

2. Discussion of the Related Art

As disclosed in U.S. Pat. Nos. 2,221,776, 2,297,691 and 2,357,809 and other publications, conventional electrophotography utilized in apparatuses for forming fixed images, such as laser printers and dry-type electrostatic copy machines, comprises the steps of forming an electrostatic latent image by evenly charging a photoconductive insulating layer (a charging process) and subsequently exposing the layer to eliminate the charge on the exposed portion (an exposing process) and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process).

In the above methods, the fixing process utilizes heat contact fixing methods, such as heat roller fixing, or heat non-contact fixing methods, such as oven fixing. The contact fixing method has excellent thermal efficiency, and when compared with the non-contact fixing method, the fixing temperature can be lowered to a desired level required for fixing devices, so that the contact fixing method is effective in energy conservation and miniaturization of the copy machines. However, the heat contact fixing method is liable to cause a so-called "offset phenomenon," wherein the toner is adhered to the surface of the heat roller, and thus transferred to a subsequent transfer paper.

In order to prevent this phenomenon, the surface of a heat roller is coated with a material having excellent release properties for the toner such as fluororesins, or with a releasing agent, such as a silicone oil. However, in the method of coating with a releasing agent, the overall fixing apparatus becomes notably complicated, thereby making it liable to bring about various problems such as high costs and device troubles.

Conventionally, vinyl resins typically represented by styrene-acrylic acid copolymers are used for these kinds of toners. In the case of using the vinyl resins, when the offset resistance is aimed to be increased, the softening points of the resins and the crosslinking density have to be increased, thereby undesirably deteriorating the low-temperature fixing ability. On the other hand, when too much emphasis is placed on the low-temperature fixing ability, problems in offset resistance and blocking resistance are liable to take place.

Also, as disclosed in Japanese Patent Laid-Open No. 49-65232, 50-28840, and 50-81342, various methods for adding offset inhibitors, such as paraffin waxes, low-molecular weight polyolefins, and the like, have been known. However, when the amount of the offset inhibitors added is too small, sufficient effects cannot be obtained, and when the amount is too large, the developer undergoes deterioration too quickly.

On the other hand, as for binder resins for toners, polyester resins are used because of their remarkably excellent low-temperature fixing abilities. The polyester resins have inherently good fixing ability, and as disclosed in U.S. Pat. No. 3,590,000, the toner using it can be sufficiently fixed even by a non-contact fixing method. However, since the offset phenomenon is liable to take place, it has been difficult to use these polyester resins in the heat roller fixing method. Japanese Patent Laid-Open Nos. 50-44836, 57-37353, and 57-109875 discloses the use of polycarboxylic acids for forming the polyester resins to improve the offset resistance. However, in these methods, a sufficiently good offset resistance to a practical level cannot be achieved, and even if such a good offset resistance is achieved, the low-temperature fixing ability inherently owned by the polyester resins is in turn deteriorated, and the pulverizability of the resin itself and that of the mixed material in the toner production become poor.

In order to solve the above problems, the following methods for blending polyester resins having excellent fixing ability with styrene-acrylic resins have been known. For instance, examples of such methods include:

(1) Methods for blending polyester resins with styrene-acrylic resins (see Japanese Patent Laid-Open Nos. 49-6931, 54-114245, 57-70523, and 2-161464);

(2) Methods for chemically binding polyester resins with styrene-acrylic resins (see Japanese Patent Laid-Open No. 56-116043);

(3) Methods for copolymerizing unsaturated polyesters with vinyl monomers (see Japanese Patent Laid-Open Nos. 57-60339, 63-279265, 1-156759 and 2-5073);

(4) Methods for copolymerizing polyester resins having an (meth)acryloyl group with vinyl monomers (see Japanese Patent Laid-Open No. 59-45453);

(5) Methods for copolymerizing reactive polyesters with vinyl monomers in the presence of polyester resins (see Japanese Patent Laid-Open No. 2-29664); and (6) Methods for forming a block copolymer by binding polyester resins and vinyl resins with an ester bond (see Japanese Patent Laid-Open No. 2-881).

However, since the polyester resins have inherently poor compatibility with the styrene-acrylic resins, mere mechanical blending of the components may result in poor dispersibility of internal additives, such as resins and carbon blacks, so that toners are unevenly charged, thereby causing background in the formed images of the toner produced in certain blending ratios. Also, in the case where the two resins have different molecular weights, the difference in their melt viscosities is liable to be caused, which in turn makes it difficult to produce the dispersed domains with fine particle size. Therefore, when toners are produced, the dispersibility of the internal additives, such as carbon blacks, becomes poor, thereby significantly lowering the image stability. Further, in the case where the vinyl monomers are copolymerized with the reactive polyesters, it is applicable only in a restricted compositional range in order not to allow gelation to take place.

In view of the above, the present inventors have developed, as a developer having both good low-temperature fixing ability and offset resistance, a developer composition using a binder resin obtainable by the method comprising the steps of adding starting monomer mixtures for condensation polymerization reaction and addition polymerization reaction having independent reaction paths to each other in one reaction vessel in advance, and concurrently carrying out condensation polymerization reaction and addition polymerization reaction (Japanese Patent Laid-Open No. 4-142301).

In addition, the present inventors have developed a method for producing a binder resin with improved resin dispersibility, comprising further adding a compound which reacts with starting material monomers of condensation polymerization reaction and addition polymerization reaction, thereby improving the dispersibility of the resins.

However, in cases where resins suitably dispersing polyester resins and styrenic resins are produced by the above methods, since the vinyl resins constituting the dispersed domains have a narrow molecular weight distribution, simply lowering the molecular weight of the vinyl resin leads to improvements only in the fixing ability, limitation is set on the improvements in offset resistance. On the other hand, when the molecular weight is made large, only the offset resistance is improved, limitation is set in lowering of the fixing temperature.

In addition, various binder resins comprising two resins having different softening points have been developed. However, even in these method, when the proportion of the resin having a lower softening point is increased, problems in blocking resistance take place in the resulting toners, though the fixing ability becomes good. On the other hand, when the glass transition temperature of the resin having a lower softening point is elevated, although the problems in the blocking resistance of the resulting toners are eliminated, the improvements in fixing ability are limited even when the proportion of the resin having a lower softening point is increased. Therefore, in view of meeting the demands for high-speed, miniaturized, conserved energy type copy machines, further improvements in low-temperature fixing ability and offset resistance are in demand.

SUMMARY OF THE INVENTION

In view of solving the above problems, an object of the present invention is to provide a binder resin for a toner having particularly excellent low-temperature fixing ability, offset resistance, and blocking resistance.

Another object of the present invention is to provide a toner for electrostatic development containing the above binder resin.

As a result of intensive research in view of the above objects, the present inventors have found that a toner having particularly excellent low-temperature fixing ability, offset resistance, and blocking resistance can be obtained by blending three different kinds of resins with different softening points, glass transition temperatures, and weight percentages of components insoluble to chloroform, and preferably using a condensation polymerization resin or a hybrid resin having good compatibility and dispersibility with each other. The present invention has been completed based upon these findings.

The present invention is concerned with the following:

(1) A binder resin for producing a toner, comprising the following three resins (A) to (C):

resin (A) having a softening point of 120° C. or more and 170° C. or less, a glass transition temperature of 58° C. or more and less than 75° C., and a weight percentage of components insoluble to chloroform at 25° C. of 5% by weight or more and 50% by weight or less;

resin (B) having a softening point of 90° C. or more and 120° C. or less, a glass transition temperature of 58° C. or more and less than 75° C., and a weight percentage of components insoluble to chloroform at 25° C. of less than 5% by weight; and resin (C) having a softening point of 80° C. or more and less than 110° C., a glass transition temperature of 45° C. or more and less than 58° C., and a weight percentage of components insoluble to chloroform at 25° C. of less than 5% by weight;

(2) The binder resin described in item (1) above, wherein the resins (A) to (C) are independently selected from the following resins:

(i) condensation polymerization resins; and (ii) hybrid resins obtainable by the steps of blending starting material monomers of condensation polymerization resins and starting material monomers of addition polymerization resins to give a mixture, and concurrently carrying out condensation polymerization and addition polymerization using the mixture in one reaction vessel;

(3) The binder resin described in item (2) above, wherein the mixture further contains a compound which reacts with both of the starting material monomers of condensation polymerization resins and the starting material monomers for addition polymerization resins;

(4) The binder resin described in any one of items (1) to (3) above, wherein the weight ratio between the resin (B) and the resin (C) is from 90/10 to 10/90, and wherein the weight ratio between a total amount of the resin (B)+the resin (C) and the resin (A) is from 90/10 to 10/90;

(5) The binder resin described in any one of items (2) to (4) above, wherein the condensation polymerization resins are selected from the group consisting of polyesters, polyester-polyamides, and polyamides;

(6) The binder resin described in any one of items (2) to (5) above, wherein the weight ratio between the starting material monomers of condensation polymerization resins and the starting material monomers of addition polymerization resins (condensation polymerization resins/addition polymerization resins) is from 50/50 to 95/5; and (7) A toner for electrostatic development containing at least a binder resin and a coloring agent, wherein said binder resin is selected from the binder resins as defined in any one of items (1) to (6) above.

DETAILED DESCRIPTION OF THE INVENTION

The binder resin of the present invention comprises following three resins (A) to (C):

resin (A) having a softening point of 120° C. or more and 170° C. or less, a glass transition temperature of 58° C. or more and less than 75° C., and a weight percentage of components insoluble to chloroform at 25° C. of 5% by weight or more and 50% by weight or less;

resin (B) having a softening point of 90° C. or more and 120° C. or less, a glass transition temperature of 58° C. or more and less than 75° C., and a weight percentage of components insoluble to chloroform at 25° C. of less than 5% by weight; and resin (C) having a softening point of 80° C. or more and less than 110° C., a glass transition temperature of 45° C. or more and less than 58° C., and a weight percentage of components insoluble to chloroform at 25° C. of less than 5% by weight.

Here, the term "weight percentage of components insoluble to chloroform" refers to a weight percentage of resin components insoluble even when dissolved in excess chloroform, which may be measured, for instance, by the method set forth in EXAMPLES given below.

First, the properties and compositional ratios of the three kinds of resins, resins (A) to (C), will be explained.

In the present invention, a preferred binder resin comprises the following three resins of resins (A) to (C):

resin (A) having a softening point of 130° C. or more and 165° C. or less, a glass transition temperature of 58° C. or more and less than 70° C., and a weight percentage insoluble to chloroform at 25° C. and 10% by weight or more and 50% by weight or less;

resin (B) having a softening point of 90° C. or more and 110° C. or less, a glass transition temperature of 58° C. or more and less than 70° C., and a weight percentage insoluble to chloroform at 25° C. of 0% by weight; and resin (C) having a softening point of 80° C. or more and less than 110° C., a glass transition temperature of 50° C. or more and less than 58° C., and a weight percentage insoluble to chloroform at 25° C. of 0% by weight.

In the case where the resin (A) has a softening point exceeding 170° C., a glass transition temperature of 75° C. or more, or a weight percentage insoluble to chloroform at 25° C. of exceeding 50% by weight, the resulting binder resin is liable to have poor low-temperature fixing ability. On the other hand, in the case where the resin (A) has a softening point of less than 120° C., or a weight percentage insoluble to chloroform at 25° C. of less than 5% by weight, the resulting binder resin is liable to have poor offset resistance. In addition, in the case where the resin (A) has a glass transition temperature of less than 58° C., the resulting binder resin is liable to have poor blocking resistance.

In the case where the resin (B) has a softening point exceeding 120° C., a glass transition temperature of 75° C. or more, or a weight percentage insoluble to chloroform at 25° C. of 5% by weight or more, the resulting binder resin is liable to have poor low-temperature fixing ability. On the other hand, in the case where the resin (B) has a softening point of less than 90° C., the resulting binder resin is liable to have poor offset resistance. In addition, in the case where the resin (B) has a glass transition temperature of less than 58° C., the resulting binder resin is liable to have poor blocking resistance.

In the case where the resin (C) has a softening point exceeding 110° C., a glass transition temperature of 58° C. or more, or a weight percentage insoluble to chloroform at 25° C. of 5% by weight or more, the resulting binder resin is liable to have poor low-temperature fixing ability. On the other hand, in the case where the resin (C) has a softening point of less than 80° C., the resulting binder resin is liable to have poor offset resistance. In addition, in the case where the resin (C) has a glass transition temperature of less than 45° C., the resulting binder resin is liable to have poor blocking resistance.

The differences between the resin (A) and the resin (B) or between the resin (A) and the resin (C) are preferably 20° C. or more. When the differences in the softening points are less than 20° C., the excellent properties inherently ascribed to each of the above resins (A), (B), and (C) are slightly suppressed, so that the resulting binder resin shows insufficient performance in any one of properties, such as low-temperature fixing ability, offset resistance, and blocking resistance.

In the present invention, the softening point is determined by a "koka" type flow tester, which is schematically described in JIS K 7210. A specific method of measurement will be given in Examples set forth below.

The resulting binder resin obtained after blending three resins preferably has a glass transition temperature between 56° C. or more and less than 70° C. When the binder resin has a glass temperature of 70° C. or more, the binder resin is liable to have poor low-temperature fixing ability, and when the binder resin has a glass temperature of less than 56° C., the binder resin is liable to have poor blocking resistance.

Here, the glass transition temperature in the present invention is measured by the following method.

Specifically, the "glass transition temperature (Tg)" used herein refers to the temperature of an intersection of the extension of the baseline of not more than the glass transition temperature and the tangential line showing the maximum inclination between the kickoff of the peak and the top of curves as determined with a sample using a differential scanning calorimeter ("DSC Model 210," manufactured by Seiko Instruments, Inc.), at a heating rate of 10° C./min. The sample is treated before measurement using the DSC by raising its temperature to 100° C., keeping at 100° C. for 3 minutes, and cooling the hot sample at a cooling rate of 10° C./min. to room temperature.

The weight ratio between the resin (B) and the resin (C) is preferably from 90:10 to 10:90, particularly from 80:20 to 20:80.

The weight proportion of the resin (B) is higher than the upper limit of the above range, the resulting binder resin is liable to have poor low-temperature fixing ability. On the other hand, when the weight proportion of the resin (C) is higher than the upper limit of the above range, the resulting binder resin is liable to have poor blocking resistance.

The weight ratio between the total amount of the resin (B)+resin (C) and the resin (A) is preferably from 90:10 to 10:90, particularly from 80:20 to 20:80.

The weight proportion of the total amount of the resin (B)+resin (C) is higher than the upper limit of the above range, the resulting binder resin is liable to have lowered low-temperature fixing ability, offset resistance, and smoothness of an image-bearing surface. On the other hand, when the weight proportion of the resin (A) is higher than the upper limit of the above range, the resulting binder resin is liable to have poor offset resistance.

By providing the resin (A), the resin (B), and the resin (C) in weight proportions given above, a wide range of molecular distribution can be formed, which cannot be obtained by simply blending only two kinds of the above resins (A), (B), and (C), thereby making it possible to give a toner for electrostatic development which further excels in low-temperature fixing ability and offset resistance.

The softening points, the glass transition temperatures, and weight percentages insoluble to chloroform can be easily controlled by adjusting the amount of polymerization initiators or catalysts in the starting material monomer mixtures, or by selecting an appropriate reaction conditions.

The binder resin of the present invention comprises blending three resins (A) to (C). There are a variety of embodiments for blending methods, including ones comprising simply blending the resin powders and pellets; ones comprising uniformly blending and dispersing the above resins by melt-blending, and pulverizing the molten product to form resin powders or pellet; and ones comprising producing toners by such methods as melt-kneading.

Here, the three resins refer to three kinds of resins having properties as defined in (A) to (C). Each of the resins (A) to (C) may be used alone or in combination. Therefore, for instance, the resin (A) may be used in combination of two or more kinds of the resin (A), and the same can be said for the resins (B) and (C).

The resins (A) to (C) mentioned above are resins preferably independently selected from one of the following resins:

(i) condensation polymerization resins; and (ii) hybrid resins obtainable by the steps of blending starting material monomers of condensation polymerization resins and starting material monomers of addition polymerization resins to give a mixture, and concurrently carrying out the condensation polymerization and the addition polymerization in one reaction vessel.

More preferably, the hybrid resin is obtainable using a mixture further containing a compound which reacts with both of the starting material monomers for the condensation polymerization and the starting material monomers for the addition polymerization (hereinafter simply referred to as "monomers which react for both polymerization reactions").

Since the condensation polymerization resin and the hybrid resin mentioned above have good compatibility and dispersibility with each other, when the toners are formed, the additives are uniformly dispersed, thereby providing excellent triboelectric properties in the resulting toner. Further, in the case where the monomers which react with both polymerization reactions are employed, the above effects are more notably obtained.

First, (ii) the hybrid resin will be explained below.

In the present invention, the condensation polymerization resin components contained in the hybrid resins include, for instance, one or more resins selected from the group consisting of polyesters, polyester-polyamides, and polyamides.

Therefore, the starting material monomers for the condensation polymerization resins are not particularly limited as long as these resins are obtainable by condensation polymerization.

Among the above resin components, the starting material monomers for forming the polyesters include dihydric alcohol monomers or trihydric or higher polyhydric alcohol monomers, and dicarboxylic acid monomer components or tricarboxylic or higher polycarboxylic acid monomer components, or acid anhydrides thereof, or lower alkyl esters thereof.

Here, examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A and other dihydric alcohol components.

Among the dihydric alcohol components, a preference is given to bisphenol A alkylene oxide adducts, ethylene glycol, 1,2-propylene glycol, 1,3-propylene glycol, and neopentyl glycol.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohol components.

Among the trihydric or higher polyhydric alcohol components, a preference is given to glycerol and trimethylolpropane.

In the present invention, these dihydric alcohol monomers and trihydric or higher polyhydric alcohol monomers may be used singly or in combination.

Examples of the dicarboxylic acid components include maleic acid, fumaric acid, citraconic acid, iraconic acid, glutaconic acid, phthalic acid, isophthalic acid, terephthalic acid, cyclohexanedicarboxylic acid, succinic acid, adipic acid, sebacic acid, azelaic acid, and malonic acid; alkenylsuccinic acids, such as n-dodecenylsuccinic acid and i-dodecenylsuccinic acid; alkylsuccinic acids, such as n-dodecylsuccinic acid; acid anhydrides thereof, lower alkyl esters thereof, and other dicarboxylic acid components.

Among the dicarboxylic acid components, a preference is given to maleic acid, fumaric acid, terephthalic acid, adipic acid, and alkenylsuccinic acids.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof, and other tricarboxylic or higher polycarboxylic acid components. In particular, among the tricarboxylic or higher polycarboxylic acid components, a preference is given to 1,2,4-benzenetricarboxylic acid, namely trimellitic acid, or derivatives thereof because they are inexpensive and have easy reaction control.

In the present invention, these dicarboxylic acid monomers and tricarboxylic or higher polycarboxylic acid monomers may be used singly or in combination.

As for the starting material monomers for forming the polyester-polyamides or the polyamides, other than the those listed as starting material monomers given above, the starting material monomers for forming the amide components are essential. Examples of the starting material monomers for forming the amide components include polyamines such as ethylenediamine, pentamethylenediamine, hexamethylenediamine, diethylenetriamine, iminobispropylamine, phenylenediamine, xylylenediamine, and triethylenetetramine; amino carboxylic acids such as 6-aminocaproic acid and ε-caprolactam; and amino alcohols such as propanolamine. Among these starting material for forming the amide components, a preference is given to hexamethylenediamine and ε-caprolactam.

Incidentally, the above starting material monomers may include those normally classified as open-ring polymerization monomers for the following reasons. Since these open-ring monomers are subject to condensation polymerization owing to hydrolysis caused by the presence of water molecules formed by the condensation polymerization reaction of other monomers, they can be included as starting material monomers for forming the condensation polymerization resins in a broad sense.

Examples of the starting material monomers for forming the addition polymerization resins in the present invention include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate, and vinyl caproate; ethylenic monocarboxylc acids and esters thereof, such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers of ethylenic monocarboxylic acids such as acrylonitrile, methacrylonitrile, and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the starting material monomers for forming the addition polymerization resins, a preference is given to, other than those listed as monomers which react for both polymerization reactions, to styrene, α-methylstyrene, propylene, methyl acrylate, butyl acrylate, 2-ethylhexyl acrylate, stearyl acrylate, methyl methacrylate, butyl methacrylate, and 2-hydroxyethyl methacrylate.

In the polymerization of the starting material monomers for forming the addition polymerization resins, a crosslinking agent may be added, if necessary, to the monomer composition. Examples of crosslinking agents for the addition polymerization monomers include any of the generally known crosslinking agents, such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably 0.01 to 15% by weight, more preferably 0.1 to 10% by weight, based on the starting material monomers for forming the addition polymerization resins. When the amount of these crosslinking agents used is more than 15% by weight, the resulting toner is less liable to be melted with heat, thereby resulting in poor heat fixing ability and poor heat-and-pressure fixing ability.

Examples of the polymerization initiators to be used in the polymerization of the starting material monomers for forming the addition polymerization resins include azo and diazo polymerization initiators, such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators, such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer, two or more polymerization initiators may be used in combination.

The amount of the polymerization initiator used is 0.1 to 20 parts by weight, preferably 1 to 10 parts by weight, based on 100 parts by weight of the starting material monomers for forming the addition polymerization resins.

In the present invention, in order to produce a resin obtainable by chemically binding the condensation polymerization resin and the addition polymerization resin, it is preferable to carry out polymerization using a compound which reacts with both the condensation polymerization resin and the addition polymerization resin.

Examples of the monomers which react with both polymerization reactions may partially overlap with the starting material monomers for forming the condensation polymerization resins and the starting material monomers for forming the addition polymerization resins, including fumaric acid, acrylic acid, methacrylic acid, citraconic acid, maleic acid, and dimethyl fumarate, among which a preference is given to fumaric acid, acrylic acid, and methacrylic acid.

The amount of the monomers which react with both the polymerization reactions is from 3 to 15% by weight, preferably 3 to 10% by weight, in the starting material monomers for forming the addition polymerization resins. When the amount of the monomers which react with both the polymerization reactions is less than 3% by weight, the resinous components comprising the condensation polymerization resins and the addition polymerization resins are not liable to have good compatibility, so that the resulting toner has a large island-sea structure. Therefore, the additives, such as coloring agents, are poorly dispersed in the toners, thereby making liable to cause poor triboelectric stability and have printing unevenness. Also, when the amount exceeds 15% by weight, the gelation is liable to take place in the polymerization reaction.

In the method for producing the hybrid resin using the starting materials mentioned above, the condensation polymerization reaction and the addition polymerization reaction are concurrently carried out in one reaction vessel. Here, the term "concurrently" used herein does not necessarily mean that both of the polymerization reactions proceed or terminate at the same time, and the reaction temperature and time can be suitably selected so as to proceed or terminate each reaction according to each of the reaction mechanisms.

The polymerization reaction is, for example, carried out by the method comprising the steps of adding dropwise a mixture comprising a starting material monomer, crosslinking agents and a polymerization initiator for the vinyl resins to a starting material monomer mixture for polyesters, polyester-polyamides, or polyamides under temperature conditions appropriate for the addition polymerization reaction, the condensation polymerization being partly carried out concurrently with the addition polymerization reaction; keeping the temperature of the obtained mixture under said temperature conditions to complete only the addition polymerization reaction; and then raising the reaction temperature to complete the condensation polymerization. Here, although the temperature conditions appropriate for the addition polymerization reaction may vary depending upon the types of the polymerization initiators, they are normally 50° to 180° C., and the optimum temperature for increasing degree of the condensation polymerization is normally 190° to 270° C.

In the present invention, by carrying out the condensation polymerization reaction and the addition polymerization reaction concurrently in one reaction vessel, binder resins in which the condensation polymerization resins and the addition polymerization resins are sufficiently blended and dispersed can be obtained. Incidentally, in the case where the monomers which react with both the polymerization reactions are employed, these monomers which react with both polymerization reactions may be previously added to the starting material monomers for forming the condensation polymerization resins, or they may be added to the starting material monomers for forming the addition polymerization resins.

In the present invention, the weight ratio of the starting material monomers for forming the condensation polymerization resins to the starting material monomers for forming the addition polymerization resins in the production of the hybrid resins, i.e. condensation polymerization resin/addition polymerization resin, is preferably from 50/50 to 95/5, within which range the fixing properties are not impaired by the affinity with the paper because of dispersion of the addition polymerization resins in the condensation polymerization resin used as a matrix.

Next, (i) the condensation polymerization resins will be explained.

As for (i) the condensation polymerization resins, for instance, one or more resins selected from the group consisting of polyesters, polyester-polyamides, and polyamides may be suitably used, which may be in the forms of homopolymers or copolymers thereof, obtainable by carrying out condensation polymerization reaction of the starting material monomers for forming the condensation polymerization resins. Examples of the monomers for forming the condensation polymerization resins include the same ones listed as examples of alcohol monomer components, carboxylic acid monomer components, and amine compounds in the description of the hybrid resins given above.

Also, the methods for carrying out the condensation polymerization are not particularly limited, and any of the known methods may be used. For instance, the condensation polymerization may be conducted by esterification or transesterification of the above monomers while adding catalysts, where necessary.

The toner for electrostatic development of the present invention comprises at least a binder resin and a coloring agent, wherein the binder resins mentioned above are included as a binder resin component. The toner of the present invention can be produced by uniformly blending the binder resin of the present invention obtained as above together with a coloring agent, or blending the resin (A) to the resin (C) before blending together with a coloring agent, and then melt-kneading, cooling, pulverizing, and classifying by conventional methods. Also, in the production of the toners, charge control agents and magnetic materials may be optionally added.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, and the mixtures thereof. The coloring agent is preferably used in an amount of about 1 to 15 parts by weight, based on 100 parts by weight of the binder resin.

In the present invention, the charge control agents optionally added to the binder resin may be either positive or negative charge control agent. The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins such as "AFP-B" (manufactured by Orient Chemical Co., Ltd.); and imidazole derivatives, with a preference given to BONTRON N-07 and AFP-B.

Negative charge control agents to be added are not particularly limited, and examples thereof include azo dyes containing metals such as "VARIFAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), "T-77" (manufactured by Hodogaya Chemical Co., Ltd.), and "AIZEN SPILON BLACK TRH" (manufactured by Hodogaya Chemical Co., Ltd.); copper pthalocyanine dye; metal complexes of alkyl derivatives of salicylic acid such as "BONTRON E-81" (manufactured by Orient Chemical Co., Ltd.), "BONTRON E-82" (manufactured by Orient Chemical Co., Ltd.), "BONTRON E-84" (manufactured by Orient Chemical Co., Ltd.), and "BONTRON E-85" (manufactured by Orient Chemical Co., Ltd.); quaternary ammonium salts such as "COPY CHARGE NX VP434" (manufactured by Hoechst); and nitroimidazole derivatives, with a preference given to T-77 and AIZEN SPILON BLACK TRH.

The above charge control agents may be contained in the binder resin in an amount of 0.1 to 8.0% by weight, preferably 0.2 to 5.0% by weight.

In addition, it is preferred that waxes, such as polyolefins, are used as offset inhibitors, in an amount of from 1 to 5 parts by weight, based on 100 parts by weight of the binder resin. Examples of the polyolefins include polyethylene and polypropylene, with a preference give to those having relatively low molecular weights, and particularly those having molecular weights of 600 to 15,000 determined by the osmometric method. Also, a preference is given to the polyolefins having softening points of preferably 70° to 150° C., particularly 120° to 150° C. determined by the ring and ball method.

In the conventional toners, blending of these waxes have been difficult owing to their poor compatibility with the binder resin. By contrast, in the present invention, such waxes can be easily blended, the low-temperature fixing ability of the resulting toner is further notably improved by containing these waxes in the toner of the present invention.

Further, in the production of the toners, property improvers, for instance, fluidity improvers such as hydrophobic silica, may be also added. When the binder resin described above is used for the production of the toners in the present invention, these property improvers may not be necessary. Even if they are used, they are contained in a small amount.

The toners having an average particle size of 5 to 15 μm can be obtained by the steps of uniformly dispersing the binder resin according to the present invention, a coloring agent, and in certain cases, property improvers, melt-kneading the obtained mixture, cooling kneaded mixture, pulverizing the cooled mixture, and then classifying the pulverized product, all of the steps being carried out by known methods. The toners may be used as a nonmagnetic one-component developer. Alternatively, the toners may be blended with particulate magnetic materials such as iron oxide carriers, spherical iron oxide carriers or ferrite carriers themselves, or the above carriers coated with resins, to give a dry-type two-component developer.

A magnetic toner can be prepared by adding a particulate magnetic material to the starting material containing the binder resin obtained according to the present invention used in toner production. Examples of the particulate magnetic materials include ferromagnetic metals such as iron, cobalt, and nickel, alloys thereof, and ferromagnetic compounds containing these elements, such as ferrite, hematite, and magnetite. Such a magnetic material is uniformly dispersed in the binder resin in the form of a fine powder having an average particle diameter of 0.1 to 1 μm. The content of these magnetic materials is preferably 30 to 120 parts by weight, based on 100 parts by weight of the binder resin.

By using the binder resin of the present invention, a toner for electrostatic development having excellent blocking resistance can be obtained. Moreover, in a fixing method using a heat roller, fixing at a low temperature can be performed without using an offset inhibiting liquid even when high-speed fixing is carried out.

EXAMPLES

The present invention is hereinafter described in more detail by means of the following resin production examples, examples, comparative examples, and test example, without intending to limit the scope of the present invention thereto. Incidentally, in these examples, the softening point and the glass transition temperature (Tg) of the resulting binder resin and the weight percentage of components insoluble to chloroform were measured by the following methods.

Softening Point

The "softening point" refers to the temperature corresponding to one-half of the height (h) of the S-shaped curve showing the relationship between the downward movement of a plunger (flow length) and temperature, namely, a temperature at which a half of the resin flows out, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

Glass Transition Temperature (Tg)

The glass transition temperature (Tg) refers to the temperature of an intersection of the extension of the baseline of not more than the glass transition temperature and the tangential line showing the maximum inclination between the kickoff of the peak and the top thereof as determined with a sample using a differential scanning calorimeter ("DSC Model 210," manufactured by Seiko Instruments, Inc.), at a heating rate of 10° C./min. The sample is treated before measurement using the DSC by raising its temperature to 100° C., keeping at 100° C. for 3 minutes, and cooling the hot sample at a cooling rate of 10° C./min. to room temperature.

Weight Percentage of Components Insoluble to Chloroform

Five grams of a resin, 5 g of "RADIOLITE" (manufactured by Showa Kagaku Kogyo K.K.) and 100 ml of chloroform are placed in a 100 cc-glass bottle equipped with a screw cap, and the contents are agitated and dissolved in a ball mill at 25° C. for 5 hours, to give a resin liquid mixture. Thereafter, a filter paper (No. 2 Paper, manufactured by Toyo Roshi Kaisha, Ltd.) having a diameter of 70 mm is placed on a pressure filtration device made of stainless steel, and 5 g of RADIOLITE is evenly packed thereon. Subsequently, the above resinous liquid mixture is gradually placed on the RADIOLITE-packed filtration device, and additional 100 ml of chloroform is added thereto. Thereafter, pressure filtration is carried out at 25° C. until a point where no filtrate is produced. Subsequently, the resulting product together with the filter paper are taken out of the filtration device, and then the product is placed in a vacuum dryer and subjected to drying at 50° C. and 160 Torr for 12 hours. Further, a weight percentage of components insoluble to chloroform is calculated according to the following equation:

$$\text{Components of Insoluble to Chloroform (\% by weight)} = \frac{\text{Solids on Filter Paper (g)} - \text{Filter Paper (g)} - \text{RADIOLITE } 10\text{ g}}{5\text{ g}} \times 100$$

Resin Production Example of Condensation Polymerization Resin

The starting materials shown in Tables 1 and 2 were placed in a three-liter, four-neck glass flask equipped with a thermometer, a stainless steel stirring rod, a reflux condenser, and a nitrogen inlet tube, and the components were allowed to react with one another while heating in a mantle heater at a temperature of 220° C. in a nitrogen gas atmosphere.

The degree of polymerization was monitored from a softening point measured according to ASTM E 28-67, and the reaction was terminated when the softening point reached a given temperature, at which point the resulting resin was taken out from the flask, cooled, and pulverized.

The softening point, the glass transition temperature, and weight percentage of components insoluble to chloroform of the resulting resin are shown in Table 3.

Resin Production Example of Hybrid Resin

The starting materials of the condensation polymerization resin shown in Tables 1 and 2 were placed in a three-liter, four-neck glass flask equipped with a thermometer, a stainless steel stirring rod, a reflux condenser, and a nitrogen inlet tube. While stirring the above components at a temperature of 135° C. in a nitrogen gas atmosphere, a starting material mixture for forming the addition polymerization shown in Table 2 was added dropwise over a period of 4 hours, the starting material mixture being previously blended. The resulting mixture was matured while maintaining the temperature of 135° C. Thereafter, the components were heated to a temperature of 230° C., and then allowed to react with one another at that temperature.

The degree of polymerization was monitored from a softening point measured according to ASTM E 28-67, and the reaction was terminated when the softening point reached a given temperature, at which point the resulting resin was taken out from the flask, cooled, and pulverized.

The softening point, the glass transition temperature, and weight percentage of components insoluble to chloroform of the resulting resin are shown in Table 3.

TABLE 1

| No. | BPA · PO | BPA · EO | i-DSA | TPA | TMA | AA | FA |
|---|---|---|---|---|---|---|---|
| A-1 | 350 g 1.0 mol | 325 g 1.0 mol | 54 g 0.2 mol | | 58 g 0.3 mol | | 211 g 1.8 mol |
| A-2 | 490 g 1.4 mol | 195 g 0.6 mol | 108 g 0.4 mol | 166 g 1.0 mol | 58 g 0.3 mol | | |
| A-3 | 35 g 0.1 mol | 618 g 1.9 mol | | 249 g 1.5 mol | 38 g 0.2 mol | | 35 g 0.3 mol |
| A-4 | 700 g 2.0 mol | 33 g 0.1 mol | 134 g 0.5 mol | 166 g 1.0 mol | 96 g 0.5 mol | 7 g 0.1 mol | |
| B-1 | 700 g 2.0 mol | 650 g 2.0 mol | 108 g 0.4 mol | 498 g 3.0 mol | 116 g 0.6 mol | | |
| B-2 | 490 g 1.4 mol | 195 g 0.6 mol | 54 g 0.2 mol | 265 g 1.6 mol | 38 g 0.2 mol | 28 g 0.4 mol | |
| B-3 | 700 g 2.0 mol | | 54 g 0.2 mol | 249 g 1.5 mol | 58 g 0.3 mol | | 23 g 0.2 mol |
| B-4 | 140 g 0.4 mol | 1236 g 3.8 mol | 108 g 0.4 mol | 332 g 2.0 mol | 76 g 0.4 mol | | 46 g 0.4 mol |
| C-1 | 980 g 2.8 mol | 195 g 0.6 mol | | 249 g 1.5 mol | 38 g 0.2 mol | | 211 g 1.8 mol |
| C-2 | 70 g 0.2 mol | 1236 g 3.8 mol | 134 g 0.5 mol | 498 g 3.0 mol | 58 g 0.3 mol | | |
| C-3 | 700 g 2.0 mol | 325 g 1.0 mol | 54 g 0.2 mol | 332 g 2.0 mol | 58 g 0.3 mol | | 59 g 0.5 mol |
| C-4 | 1050 g 3.0 mol | | | 481 g 2.9 mol | 38 g 0.2 mol | 7 g 0.1 mol | |

TABLE 2

| No | HMDA | DBO | St | EHA | n-BA | DCP |
|---|---|---|---|---|---|---|
| A-1 | | 3 g 12 mmol | | | | |
| A-2 | 23 g 0.2 mol | 3 g 12 mmol | | | | |
| A-3 | | 3 g 12 mmol | 416 g 4.0 mol | | 130 g 1.0 mol | 20 g 0.08 mol |
| A-4 | | 3 g 12 mmol | 208 g 2.0 mol | 34 g 0.2 mol | | 20 g 0.08 mol |
| B-1 | | 6 g 24 mmol | | | | |
| B-2 | | 3 g 12 mmol | 208 g 2.0 mol | 34 g 0.2 mol | | 20 g 0.08 mol |
| B-3 | 23 g 0.2 mol | 3 g 12 mmol | | | | |
| B-4 | | 6 g 24 mmol | | | | |
| C-1 | | 3 g 12 mmol | | | | |
| C-2 | | 3 g 12 mmol | | | | |
| C-3 | | 3 g 12 mmol | 208 g 2.0 mol | 34 g 0.2 mol | | 20 g 0.08 mol |
| C-4 | | 3 g 12 mmol | 312 g 3.0 mol | 68 g 0.4 mol | | 20 g 0.08 mol |

In Tables 1 and 2, the following abbreviations are used.

BPA·PO: Polyoxypropylene(2.2)-2,2-bis(4-hydroxyphenyl)propane

BPA·EO: Polyoxyethylene(2.2)-2,2-bis(4-hydroxyphenyl)propane i-DSA: Isododecenylsuccinic acid anhydride TPA: Terephthalic acid TMA: 1,2,4-benzenetricarboxylic acid (trimellitic acid) anhydride AA: Acrylic acid (Monomer which reacts with both polymerization resins)

FA: Fumaric acid (Monomer which reacts with both polymerization resins)

HMDA: Hexamethylenediamine

DBO: Dibutyltin oxide

St: Styrene

EHA: 2-Ethylhexyl acrylate n-BA: n-Butyl acrylate

DCP: Dicumyl peroxide

TABLE 3

| No. | | Softening Point (°C.) | Glass Transition Temperature (°C.) | Percentage of Insoluble Compon. in Chloroform (% by weight) |
|---|---|---|---|---|
| A | 1 | 144 | 62 | 22 |
| | 2 | 139 | 60 | 16 |
| | 3 | 151 | 64 | 25 |
| | 4 | 162 | 62 | 29 |
| B | 1 | 106 | 60 | 0 |
| | 2 | 101 | 61 | 0 |
| | 3 | 103 | 59 | 0 |
| | 4 | 96 | 58 | 0 |
| C | 1 | 89 | 52 | 0 |
| | 2 | 95 | 54 | 0 |
| | 3 | 105 | 56 | 0 |
| | 4 | 100 | 51 | 0 |

Examples 1 to 4 and Comparative Examples 1 to 3

In each of Examples and Comparative Examples, binder resins with combinations and amounts shown in Table 4, a total amount of the binder resins being 100 parts by weight, 7 parts by weight of a carbon black "MOGAL L" (manufactured by Cabot Corporation), and 2 parts by weight of a low-molecular weight polypropylene "VISCOL 660P" (softening point: 130° C., manufactured by Sanyo Chemical Industries, Ltd.), and 1 part by weight of a charge control agent "BONTRON S-34" (manufactured by Orient Chemical Co., Ltd.) were previously blended, and then the resulting mixture was melt-blended using a twin-screw extruder. After the extruded product was cooled, the product was subjected to pulverization and classification in a conventional manner, to give each of an untreated toner having an average particle size of 10 μm.

0.3 parts by weight of a hydrophobic silica "H-2000" (manufactured by Wacker Chemical Co.) was blended with 100 parts by weight of each of the resulting untreated toners using a Henschel mixer to give Toners 1 to 4 and Comparative Toners 1 to 3.

A developer was prepared by blending 39 parts by weight of each of the toners with 1261 parts by weight of spherical ferrite powder coated with styrene-methyl methacrylate resin having an average particle size of 100 μm.

Test Example

Each of the developers prepared as described above was loaded on a commercially available, two-component, dry-type copy machine to form images. The copy machine was a modified apparatus of "SF9800" (manufactured by Sharp Corporation) which was equipped with an amorphous selene photoconductor and a fixing roller having a rotational speed of 265 mm/sec. A fixing device thereof was able to be set at variable heat roller temperature and an oil applying device was removed therefrom. The fixing ability (lowest fixing temperature), the offset resistance (hot offset generating temperature), and the blocking resistance were evaluated by the following methods.

(1) Lowest Fixing Temperature

The lowest fixing temperature used herein referred to the temperature of the fixing roller at which the fixing ratio of the toner exceeded 70%. This fixing ratio of the toner was determined by placing a load of 500 g on a sand-rubber eraser (LION No. 502) having a bottom area of 15 mm×7.5 mm which contacted the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from this density value and a density value before the eraser treatment using the following equation.

$$\text{Fixing ratio (\%)} = \frac{\text{Image density after eraser treatment}}{\text{Image density before eraser treatment}} \times 100$$

By controlling the fixing roller temperature from 90° C. to 240° C., the fixing ability of the formed images was evaluated. The results are shown in Table 4.

(2) Hot-Offset Generating Temperature

In accordance with the measurement for the lowest fixing temperature described above, fixing was carried out by transferring and fixing visible images with the above-described fixing roller, and then conveying white transfer papers through the fixing roller under the same conditions as above, to confirm whether or not toner dusts were generated by gross examination. This operation was repeated at an increment of 5° C. in a given temperature range. The "hot offset generating temperature" referred to the lowest set temperature at which toner dusts were generated. The results are shown in Table 4.

(3) Blocking Resistance

Ten grams of toners were placed in a 100 ml glass bottle, and the conditions of the toners were evaluated after the toners were kept standing under the conditions of 50° C. temperature and 26% relative humidity by the following standards:

○: No blocking was observed.

Δ: Toners were in a soft caking state.

x: Toners were in a hard caking state.

The results are shown in Table 4.

TABLE 4

| Toner No. | Resin (A) No. | Resin (A) Softening (°C.) | Resin (A) Amount (parts by wt.) | Resin (B) No. | Resin (B) Softening (°C.) | Resin (B) Amount (parts by wt.) | Resin (C) No. | Resin (C) Softening (°C.) | Resin (C) Amount (parts by wt.) | Hot Offset Generating Temp. (°C.) | Lowest Fixing Temp. (°C.) | Blocking Resistance |
|---|---|---|---|---|---|---|---|---|---|---|---|---|
| Toners | | | | | | | | | | | | |
| 1 | A-1 | 144 | 50 | B-1 | 106 | 25 | C-1 | 89 | 25 | 240< | 116 | ○ |
| 2 | A-2 | 139 | 40 | B-2 | 101 | 15 | C-2 | 95 | 45 | 240< | 110 | ○ |
| 3 | A-3 | 151 | 20 | B-3 | 103 | 40 | C-3 | 105 | 40 | 240< | 106 | ○ |
| 4 | A-4 | 162 | 40 | B-4 | 96 | 20 | C-4 | 100 | 40 | 240< | 108 | ○ |
| Comparative Toners | | | | | | | | | | | | |
| 1 | A-1 | 144 | 50 | B-1 | 106 | 50 | | | | 240< | 135 | ○ |
| 2 | | | | B-2 | 101 | 55 | C-2 | 95 | 45 | 150 | 98 | X |
| 3 | A-4 | 162 | 50 | | | | C-4 | 100 | 50 | 240< | 110 | X |

As is clear from the above results, all of Toners 1 to 4 of the present invention showed excellent offset resistance, low-temperature fixing ability, and blocking resistance, so that the toners having particularly excellent thermal properties were obtained.

On the other hand, in the case of Comparative Toner 1 where only the resin (A) and the resin (B) were used, the resulting toner had poor low-temperature fixing ability; in the case of Comparative Toner 2 where only the resin (B) and the resin (C) were used, the resulting toner had particularly poor offset resistance and poor blocking resistance; and in the case of Comparative Toner 3 where only the resin (A) and the resin (C) were used, the resulting toner had poor blocking resistance.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A binder resin composition for producing a toner, comprising a blend of the following three resins (A) to (C):

resin (A) having a softening point of 120° C. or more and 170° C. or less, a glass transition temperature of 58° C. or more and less than 75° C., and a weight percentage of components insoluble to chloroform at 25° C. of 5% by weight or more and 50% by weight or less;

resin (B) having a softening point of 90° C. or more and 120° C. or less, a glass transition temperature of 58° C. or more and less than 75° C., and a weight percentage of components insoluble to chloroform at 25° C. of less than 5% by weight; and resin (C) having a softening point of 80° C. or more and less than 110° C., a glass transition temperature of 45° C. or more and less than 58° C., and a weight percentage of components insoluble to chloroform at 25° C. of less than 5% by weight.

2. The binder resin according to claim 1, wherein the resins (A) to (C) are independently selected from the following resins:

(i) condensation polymerization resins; and (ii) hybrid resins obtainable by the steps of blending starting material monomers of condensation polymerization resins and starting material monomers of addition polymerization resins to give a mixture, and concurrently carrying out condensation polymerization and addition polymerization using the mixture in one reaction vessel.

3. The binder resin according to claim 2, wherein the mixture further contains a compound which reacts with both of the starting material monomers of condensation polymerization resins and the starting material monomers for addition polymerization resins.

4. The binder resin according to claim 1, wherein the weight ratio between the resin (B) and the resin (C) is from 90/10 to 10/90, and wherein the weight ratio between a total amount of the resin (B)+the resin (C) and the resin (A) is from 90/10 to 10/90.

5. The binder resin according to claim 2, wherein the condensation polymerization resins are selected from the group consisting of polyesters, polyester-polyamides, and polyamides.

6. The binder resin according to claim 2, wherein the weight ratio between the starting material monomers of condensation polymerization resins and the starting material monomers of addition polymerization resins (condensation polymerization resins/addition polymerization resins) is from 50/50 to 95/5.

7. A toner for electrostatic development containing at least a binder resin and a coloring agent, wherein said binder resin is selected from the binder resins as defined in any one of claims 1 to 6.

* * * * *